United States Patent [19]

Perkins et al.

[11] 3,995,695

[45] Dec. 7, 1976

[54] METHOD FOR COMPLETING A WELL IN A PERMAFROST ZONE

[75] Inventors: Thomas K. Perkins, Dallas, Tex.; Frederick W. Ng, Anchorage, Alaska

[73] Assignee: Atlantic Richfield Company, Los Angeles, Calif.

[22] Filed: Aug. 25, 1975

[21] Appl. No.: 607,147

[52] U.S. Cl. ..... 166/302; 166/312; 166/DIG. 1

[51] Int. Cl.[2] ..... E21B 43/00

[58] Field of Search ..... 138/32, 34; 166/DIG. 1, 166/312, 57, 302; 175/65

[56] References Cited

UNITED STATES PATENTS

| | | | |
|---|---|---|---|
| 3,618,680 | 11/1971 | Ellard et al. | 166/DIG. 1 |
| 3,662,832 | 5/1972 | Keeler et al. | 166/302 |
| 3,791,448 | 2/1974 | Schuh | 166/DIG. 1 |
| 3,831,678 | 8/1974 | Mondshine | 166/DIG. 1 |

OTHER PUBLICATIONS

Grayaznov, "Special Features of Drilling Deep Wells in Permanently Frozen Formations," No. 8, pp. 7–11, 1965 (Permafrost Abstracts, 11/27/65).

*Primary Examiner*—Ernest R. Purser
*Attorney, Agent, or Firm*—Roderick W. MacDonald

[57] ABSTRACT

In a method for completing a well in a permafrost zone wherein an at least partially freezable liquid may be left in at least one annulus of the well in the permafrost zone, the method of washing the freezable liquid from the at least one annulus using from about one-quarter to about four system volumes of a wash liquid, the wash liquid having a base liquid of the same class as the freezable liquid, carrying out the washing step under turbulent flow conditions, and displacing the wash liquid from the annulus with a displacement liquid which undergoes insufficient volume increase to damage the well pipe should the displacement liquid subsequently cool to the in situ temperature of the permafrost.

8 Claims, 2 Drawing Figures

METHOD FOR COMPLETING A WELL IN A PERMAFROST ZONE

BACKGROUND OF THE INVENTION

In the past, hydrocarbon deposits have been discovered in reservoirs which lie beneath a permafrost zone thereby necessitating the drilling, completion and production of wells through permafrost. Permafrost is perpetually frozen soil. Since drilling and completion methods often utilize water based fluids which will increase in volume on freezing, it is desirable not to leave a substantial amount of freezable liquid in the portion of the well which passes through the permafrost zone. Otherwise, should the well be shut in for an extended period of time, the permafrost surrounding the well could cool the freezable liquid in the well to the extent that the freezable liquid does in fact solidify and go through its undesired volume change. A sufficient volume increase in the confines of a well annulus can, in certain situations, cause undesired damage to the pipes or other apparatus in the well. Accordingly, it is desirable not to leave any substantial amount of freezable liquid in the permafrost zone of the well.

SUMMARY OF THE INVENTION

According to this invention, any freezable liquid which would otherwise be left in one or more annuli in the permafrost zone of the well is washed from the annulus or annuli using from about one-quarter to about four system volumes of a wash liquid that has a base liquid of the same class as the freezable liquid. That is to say, that if the freezable liquid is a water based material then the wash liquid should be water based; whereas if the freezable liquid is a hydrocarbon based material such as an emulsion with an internal water phase, then the wash liquid should be hydrocarbon based. This washing step should be carried out under turbulent flow conditions as hereinafter defined. After the washing step, the wash liquid is displaced from the annulus or annuli with a displacement liquid which will undergo insufficient volume increase to damage any well pipe in the permafrost zone should the displacement liquid subsequently be cooled to the in situ temperature of the permafrost.

In accordance with this invention sufficient removal of the freezable liquid from the well to avoid damage of the well should it subsequently be cooled to the in situ temperature of the permafrost is achieved by employing the combination of from about one-quarter to about four system volumes of wash liquid under turbulent flow conditions.

Accordingly, it is an object of this invention to provide a new and improved method for completing a well in a permafrost zone.

Other aspects, objects and advantages of this invention will be apparent to those skilled in the art from this disclosure and the appended claims.

DETAILED DESCRIPTION OF THE INVENTION

Figure 1:
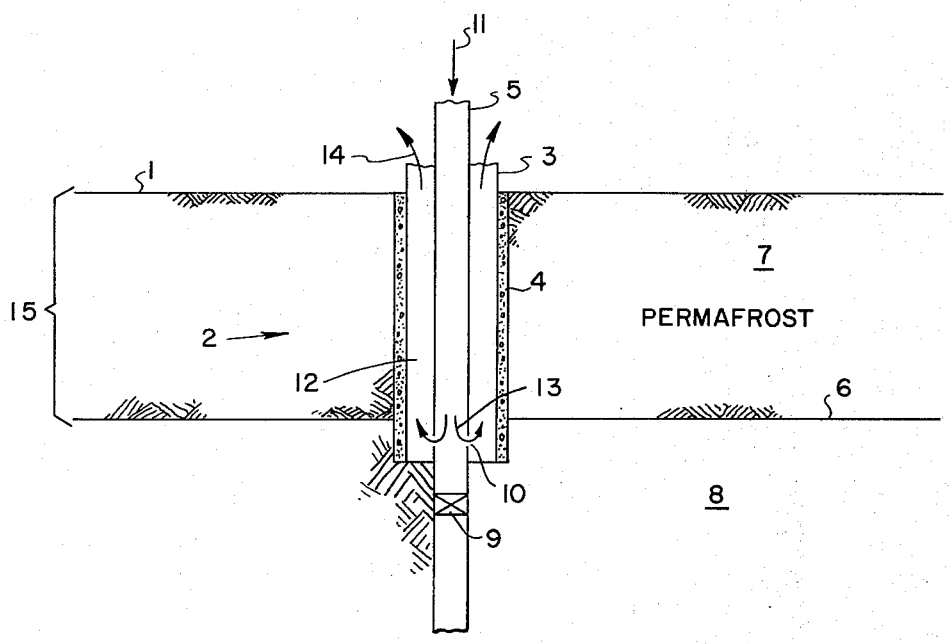
FIG. 1 shows a cross section of the well pipe in a permafrost zone.

FIG. 1 shows a cross section of a well through a permafrost zone. More specifically, the drawing shows the earth's surface 1 through which is drilled a wellbore 2. Wellbore 2 contains casing 3 cemented at 4 to the permafrost in a conventional well completion procedure. Inside casing 3 is pipe 5 which extends below bottom 6 of permafrost zone 7. Below bottom 6 is unfrozen soil 8.

Pipe 5 has a conventional packoff at 9 and apertures 10 so that any liquid pumped from the earth's surface in the direction of arrow 11 through the interior of pipe 5 passes through apertures 10 into annulus 12 between the exterior of pipe 5 and the interior of casing 3. The liquid passing from pipe 5 into annulus 12, as shown by arrows 13, passes upward through annulus 12 back to the earth's surface as shown by arrows 14.

In accordance with this invention one system volume is equal to the internal volume of pipe 5 over the length 15 of permafrost zone 7 plus the volume of annulus 12 over the same length 15. Thus, a system volume in accordance with this invention will vary depending upon the thickness of the permafrost zone or zones through which the well is completed, the volume of the conduit for passing fluid from the earth's surface into the interior of the well, i.e., pipe 5 in the drawing, and the volume of the annulus or annuli which are to be subjected to the method of this invention. Accordingly, any more specific quantitative description of the amount of wash liquid used in accordance with this invention is impossible to determine since the factors that go into determining a system volume are large in number and quantitatively uncertain until the specific well is identified. However, one skilled in the art given the above definition of a system volume can readily determine the quantity of wash fluid that can be used to practice this invention in any given well.

In accordance with this invention, if a quantity of wash fluid within the range of from about one-quarter to about four system volumes of the particular well in question is employed in combination with turbulent flow conditions in annulus 12, one can be sufficiently certain that sufficient freezable liquid has been removed from annulus 12 so that, when the wash liquid is removed from annulus 12 by a displacement liquid which is essentially nonfreezable, insufficient freezable liquid, if any, has been left in annulus 12 to cause damage to well pipe such as pipe 5 and casing 3 should the well subsequently be cooled to the in situ temperature of permafrost 7.

In accordance with this invention, an adequate turbulent flow of the wash liquid is achieved when the wash liquid is pumped into pipe 5 at a rate in gallons per minute of at least $1.16\,(D_o + D_i)\mu$, where $D_o$ equals the outside diameter in inches of the annulus in question, $D_i$ equals the inside diameter in inches of the annulus in question, and $\mu$ is the viscosity of the wash liquid in centipoise.

Figure 2:
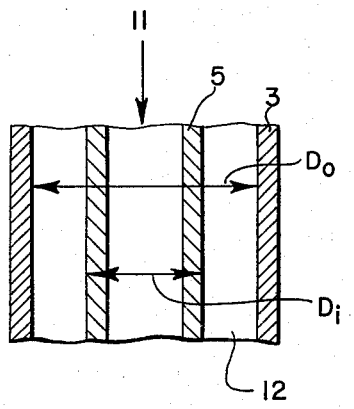
FIG. 2 shows the relative diameters and spacing of concentric well pipes according to the invention.

FIG. 2 shows the outside diameter, $D_o$, of annulus 12 to be the inside diameter of outer pipe 3 and the inside diameter, $D_i$, of annulus 12 to be the outside diameter of inner pipe 5.

In the drawing it should be noted that cement 4 is optional and is not required for this invention and that pipe 5 or similar pipe of smaller dimensions will extend on into unfrozen soil 8 to the bottom of the wellbore (not shown) or to the reservoir (not shown) if the well has been drilled that far. Also, there can be a number of other pipes besides pipe 5 and casing 3 in the portion of the wellbore that passes through the permafrost zone, a single annulus 12 being shown in the drawing for simplicity's sake only. For example, multiple sizes of casing such as 20 inch, 13-⅜ inch, 9-⅝ inch, and so on can be employed in the wellbore in permafrost zone 7 thereby necessitating the displacement of freezable liquid from more than one annulus in the permafrost zone.

Normally in drilling a well a water based drilling fluid is employed. In this invention water based or oil based means that the predominant or base liquid is water or hydrocarbon, respectively. Thus, generally, a water based drilling fluid will contain at least 10 weight percent water the remainder being various other additives including even hydrocarbons. It can thus be seen that even a hydrocarbon based drilling fluid could contain a substantial amount of water, e.g., approaching 50 volume percent of the drilling fluid, and therefore could be a freezable liquid within the scope of this invention. Thus, the freezable liquid within the scope of this invention is any liquid which when subsequently cooled to the in situ temperature of the permafrost has sufficient water present to undergo a volume increase which could do damage to one or more pipes in the wellbore in the permafrost zone.

The wash liquid should have a base liquid of the same class as the freezable liquid. A water based drilling fluid would, therefore, be washed out by a water based wash liquid and a hydrocarbon based drilling fluid would be washed out by a hydrocarbon based wash liquid. The displacing liquid should be essentially nonfreezable although some freezability is tolerable so long as the volume increase of the essentially nonfreezable liquid is insufficient to damage any well pipe. Thus, generally, the nonfreezable liquid will be a hydrocarbon or hydrocarbon based liquid which contains a relatively minor amount of water if any.

Further, it is preferable for more complete displacement of the wash liquid, since the wash liquid can be a freezable liquid in the practice of this invention, that the displacement liquid be at least one of (1) more dense than the wash liquid or (2) more viscous than the wash liquid. This helps to insure that essentially all of the wash liquid is forced from the annulus by the displacement liquid.

Other steps can be taken to help insure sufficiently complete removal of freezable liquid from the annulus in accordance with this invention. For example, a conventional wiper plug can be employed between the freezable liquid and the wash liquid, thereby cutting down on the mixing of these two liquids at their interface. The wiper plug will keep the two liquids physically separated through length 15 of pipe 5 in permafrost zone 7, i.e., until the wiper plug stops at the top of packoff 9 and the liquids then pass through apertures 10 into annulus 12. Thus, when employing a wiper plug between the freezable liquid and the wash liquid from about one-quarter to about four system volumes of wash liquid used can be reduced by the internal volume of said conduit for passing fluid from the earth's surface into the interior of the well, i.e., the internal volume of pipe 5 over length 15.

Also, a spacer liquid can be employed between the wash liquid and displacement liquid to aid in preventing mixing of the wash and displacement liquids. Spacer liquids are conventionally used in cementing wells and therefore are well-known in the art.

Thus, for example, in the apparatus of the drawing, after the well is drilled and packer 9 set, both the interior of pipe 5 above packer 9 and annulus 12 would be filled with a water based drilling fluid that contains at least 10 weight percent water, the remainder being various drilling fluid additives such as lignosulfonates, bentonite clay, barite, viscosifiers, and the like. For annulus 12 where pipe 5 is standard 9-⅝ inch oil field casing and pipe 3 is standard 13-⅜ inch oil field casing, $D_o$ is 12.347 inches, $D_i$ is 9.625 inches, and $\mu$ is 1. This freezable drilling fluid is washed from the interior of pipe 5 and annulus 12 using three system volumes of fresh water, the water being less dense than the drilling fluid because it does not have barite and the like mixed therein like the drilling fluid. The water is pumped into pipe 5 at a rate of at least 25.5 gallons per minute to insure turbulent flow of the water while washing the drilling fluid out of the well.

The water which remains in pipe 5 and annulus 12 after the washing step is displaced therefrom by injecting diesel oil with bentonite and barite dispersed therein. The gelled and weighted diesel oil is more dense than the water and therefore efficiently pushes the water out of pipe 5 and annulus 12 ahead of the incoming gelled diesel oil. After the displacing step, annulus 12 is left essentially filled with the gelled diesel oil and the water remaining, if any, in annulus 12 is so small compared to the volume of annulus 12 and the strengths of pipe 5 and casing 3 that even if the remaining water should freeze and expand it would have no deleterious effect on the well.

Reasonable variations and modifications are possible within the scope of this disclosure without departing from the spirit and scope of this invention.

The embodiments of the invention in which an exclusive property or privilege is claimed are defined as follows:

1. In a method for completing a well having a conduit therein for passing fluid from the earth's surface into the interior of the well, said well and conduit passing through a permafrost zone, there being at least one pipe annulus outside said conduit and in the permafrost zone of said well, said annulus containing an at least partially freezable liquid which will expand in volume upon cooling to the in situ temperature of said permafrost, the improvement comprising washing said freezable liquid from said annulus using from about one-quarter to about four system volumes of a wash liquid that has a base liquid of the same class as said freezable liquid, carrying out said washing step under turbulent flow conditions in each annulus which include a wash liquid pumping rate into said conduit in gallons per minute of at least $1.16\ (D_o+D_i)\mu$, where $D_o$ is the outside diameter in inches of the annulus in question, $D_i$ is the inside diameter in inches of the annulus in question, and $\mu$ is the viscosity of the wash liquid in centipoise and displacing said wash liquid from said annulus with a liquid which undergoes insufficient volume increase to damage the well when said displacement liquid cools to the in situ temperature of said permafrost.

2. A method according to claim 1 wherein said freezable liquid is a water based drilling fluid and said wash liquid is water based.

3. A method according to claim 2 wherein said displacement liquid is hydrocarbon based.

4. A method according to claim 1 wherein said freezable liquid is a hydrocarbon based drilling fluid and said wash liquid is hydrocarbon based.

5. A method according to claim 4 wherein said displacement liquid is hydrocarbon based.

6. A method according to claim 1 wherein said displacement liquid is at least one of (1) more dense than said wash liquid or (2) more viscous than said wash liquid.

7. A method according to claim 1 wherein a wiper plug is employed between said freezable liquid and said wash liquid and said from about one-quarter to about four system volumes of wash liquid is reduced by the volume of said conduit.

8. A method according to claim 1 wherein a spacer liquid is employed between said wash liquid and displacement liquid to aid in preventing mixing of said wash and displacement liquids.

* * * * *